US005152199A

United States Patent [19]

Lain

[11] Patent Number: 5,152,199

[45] Date of Patent: Oct. 6, 1992

[54] RATCHET WRENCH HEAD CONNECTOR FOR USE IN COMBINATION WITH EXPANDABLE JAW WRENCH

[76] Inventor: Lee R. Lain, P.O. Box 758, Peotone, Ill. 60468

[21] Appl. No.: 410,266

[22] Filed: Sep. 21, 1989

Related U.S. Application Data

[63] Continuation of Ser. No. 292,963, Jan. 3, 1989, abandoned.

[51] Int. Cl.[5] ..... B25G 1/00

[52] U.S. Cl. ..... 81/177.2; 81/180.1; 81/423; 81/427.5

[58] Field of Search ..... 81/177.2, 177.1, 180.1, 81/185.1, 185.2, 421–424, 427.5, 58, 58.1, 60, 61, 63, 155, 165

[56] References Cited

U.S. PATENT DOCUMENTS

D. 260,961 9/1981 Leehaug ..... 81/177.2 X 568,381 9/1896 Thompson ..... 81/180.1 X 1,456,290 5/1923 Tell ..... 81/165

4,596,167 6/1986 White, Jr. ..... 81/177.2

4,631,988 12/1986 Colvin ..... 81/63 X

OTHER PUBLICATIONS

Nasco Torque Tool Co., 85/86 Catalog, p. 11, "Standard Square Drive Ratchet".

*Primary Examiner*—D. S. Meislin

*Attorney, Agent, or Firm*—Allegretti & Witcoff, Ltd.

[57] ABSTRACT

The present invention is directed to a removable connector handle means including connector ears for use in conjunction with a ratchet wrench head having a unitary handle connected to the ratchet wrench head for turning the ratchet wrench mechanism thereof. Such improved connector means is disposed distally on the unitary handle of the ratchet wrench head for grippingly connecting to and within the jaws of an expandable jaw wrench.

5 Claims, 2 Drawing Sheets

FIG. 1
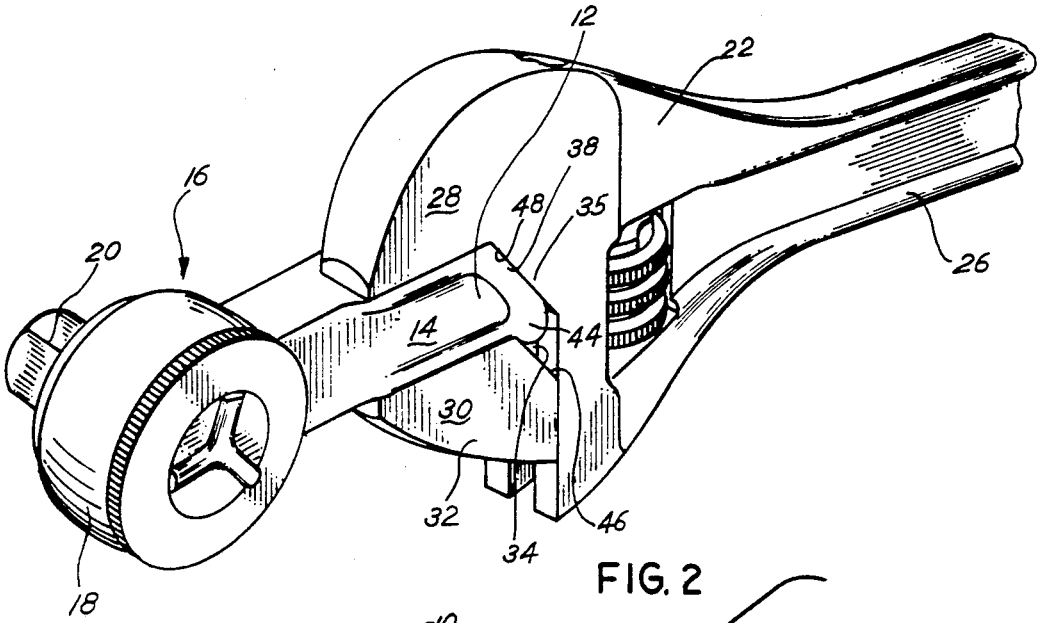
FIG. 2
FIG. 3
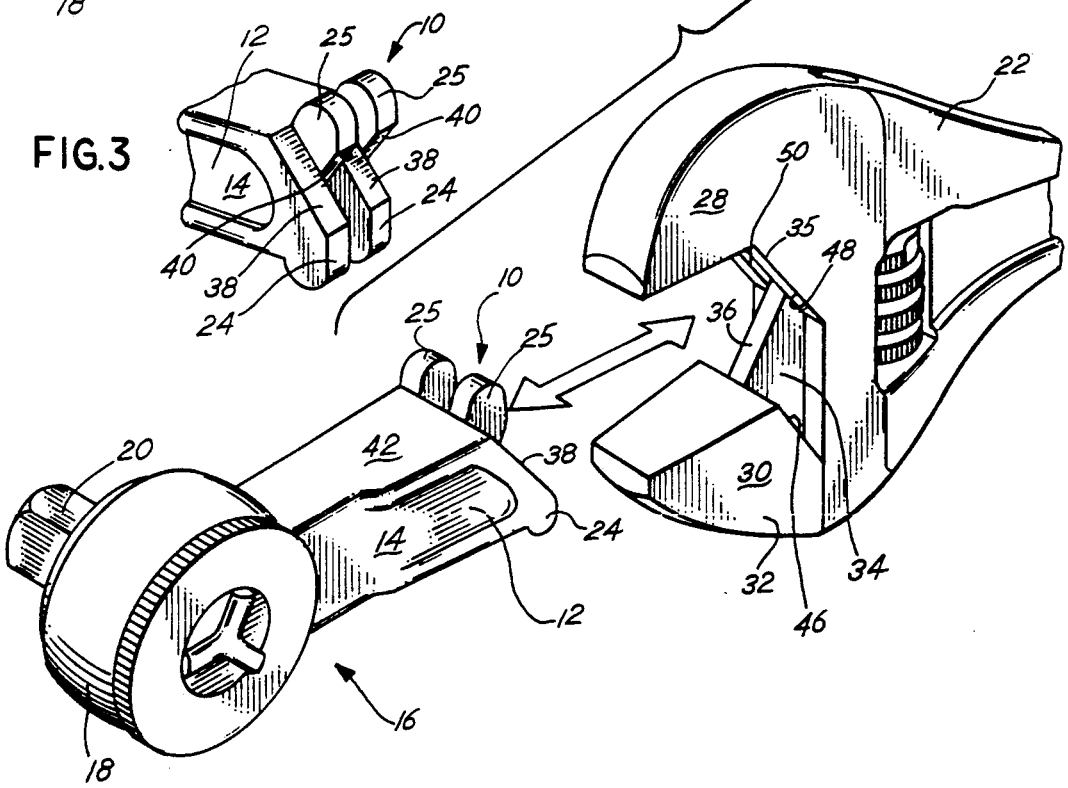

RATCHET WRENCH HEAD CONNECTOR FOR USE IN COMBINATION WITH EXPANDABLE JAW WRENCH

This is a continuation of application Ser. No. 292,963, filed Jan. 3, 1989, now abandoned.

BACKGROUND OF THE INVENTION

The present invention relates generally to the tool arts and more particularly to a ratchet wrench head connector mechanism for use in combination with an expandable jaw wrench.

In the prior art, many mechanics, workers and craftsmen have been required to carry a tool box with them on the job, such toolbox for containing a wide variety of hand tools and other implements which may be required from time to time in the performance of various job duties and functions. In such instances, space and weight are always at a premium, and any savings of either is of considerable practical benefit to such craftsman, worker, or mechanic.

One hand tool which finds frequent application in a number of situations is the ratchet wrench. Such prior art ratchet wrenches have had a ratchet head permanently connected to a relatively lengthy ratchet handle. In fact, much of the weight of the ratchet wrench in the prior art has been attributable to the ratchet wrench handle, which also takes up considerable space in the toolbox, thereby imparting substantial weight to the combined total in a toolbox.

Also, another tool which must also be found in such typical toolbox is the expandable and/or adjustable jaw wrench. However, such expandable jaw wrenches of the prior art have not been particularly useful in conjunction and/or connection with such prior art ratchet wrenches.

Certain improvements in ratchet and/or other wrench handles have been suggested to attempt to meet some of these difficulties or deficiencies in the prior art. For example, some such suggested mechanisms have necessitated surfaces with a limited contact area for torque transmission between the ratchet wrench handle and/or any ratchet wrench handle extension and such ratchet wrench. Also, the shape and/or contour of the respective contact areas of these sometimes suggested devices has provided for unwarranted and/or deleterious slippage and/or partial rotation of the adjustable wrench about the wrench and handle, thereby causing the adjustable wrench to lose torque and/or to lose required position for torque transfer, as well as creating the distinct possibility of causing or contributing to accidents and/or injuries.

In light of the above difficulties and deficiencies of such prior art devices, it has been deemed desirable to apparatus meeting certain objects, and possessing certain advantages and improvements over prior art devices. For example, it has been an object of the apparatus of the present invention to provide surfaces for disposition in direct contact with a ratchet, and more precisely where a ratchet head and expandable jaw wrench meet and engage. Such surfaces are the medium herein through which torque is transmitted from the adjustable wrench to the ratchet. Also, such surfaces are designed in the apparatus of the present invention to provide a large transfer of torque within a small area, thus reducing tool size, weight, and the amount of material required for manufacture. Also, these torque transmitting surfaces should allow an adjustable and/or expandable jaw wrench to be operated in its strongest position, because in such preferred embodiments, the moving jaw section may be entirely recessed within the wrench housing, thus, facilitating a minimum of play while maximizing full engagement and transfer of torque. And as a further object, such torque transmitting surfaces should keep the lower jaw end from protruding, thus minimizing the adjustable wrench profile presented.

In addition, the improvement of the present invention provides for a short term, removable, but firm and semi-permanent, union of a high torque ratchet head and an adjustable and/or expandable jaw wrench. The locking together of such combination in semi-permanent fashion of these two tools also serves to minimize the possibility of accidental loss of the ratchet head. In further addition, such removable but firm and semi-permanent, union of such tools prevents the adjustable wrench from slipping off the ratchet head during actual use, and/or rounding off and thereby damaging the end of the ratchet head even during extreme torque transmitting conditions—for example, such as when a "cheater" bar or pipe is applied to or utilized on the handle of the expandable jaw wrench. In addition, this feature which prevents accidental disconnection of the two tools serves to prevent gashed and/or battered hands, as well the possibility of the worker falling from heights, such as cranes, etc., because of slippage of the expandable wrench from the ratchet head.

In meeting the above objects and purposes of the present invention, yet additional features of the improved ratchet head connector means of the present invention further include the presentation of comfortable and effective hand-operated tools, and especially in the transmission of very large amounts of torque, and whether in a clockwise or counter-clockwise direction. In addition, the improved ratchet head connector means of the present invention provides a substantial margin of safety to the person using the tool. Yet, further, the mechanic or other worker is provided with a two-piece tool system which enables him to carry such tools comfortably and safely, and even on his person when necessary. For example, the ratchet wrench head may be disconnected from the expandable jaw wrench to be carried in a front or back pants pocket, while the adjustable expandable jaw wrench may be carried in the back pants pockets, or from the belt, between actual uses.

The above features of portability and convenience are also advantageous to the mechanic, as less tool retrieval time and walking time to the tool box are necessitated. In addition, a nearly instantaneous response may be provided for a given task, without the necessity for walking substantial distances to the tool box. Accordingly, employee efficiency and safety are yet additionally enhanced.

Other objects, uses, and advantages of the present invention over the prior art will become apparent to those of ordinary skill in the art upon review of the following disclosure hereof.

SUMMARY OF THE PRESENT INVENTION

The present invention is directed to a removable connector handle means for use in conjunction with a ratchet wrench head, having itself a unitary handle connected to the ratchet wrench head for turning the ratchet wrench mechanism thereof. Such improved connector means is disposed distally on the unitary handle of the ratchet wrench head for grippingly connecting to and within the jaws of an expandable jaw wrench.

In preferred embodiments, this ratchet wrench related improvement of the present invention includes certain connector ears disposed at the terminal portion of the provided relatively short handle of the ratchet wrench head, such ears having special contours for fitting within and being held securely by the jaws of an associated expandable jaw wrench. In addition, such connector ears are disposed to permit the end of the ratchet wrench head and the expandable wrench handle to be disposed in a substantially straight line which is substantially normal to axis of rotational of the ratchet.

Other aspects and embodiments of the present invention are set forth in greater detail in connection with the following brief description of the drawing, detailed description of preferred embodiments, appended claims, and accompanying drawing, infra.

BRIEF DESCRIPTION OF THE DRAWING

FIG. 1 is a perspective view of the ratchet wrench head improvement of the present invention, shown operably disposed for use within the jaws of an associated expandable jaw wrench;

FIG. 2 is a partially cut-away perspective view of the ratchet wrench head improvement in FIG. 1 shown in disconnected disposition from the associated expandable jaw wrench to reveal the connector ears disposed to be facing in a first radial direction at the terminal portion of the handle of the ratchet wrench head;

FIG. 3 is a fragmented and perspective view of first and second pairs of interlockingly disposed connector ears, which are disposed to face in an opposite radial direction from the first pair of ears;

DETAILED DESCRIPTION OF PREFERRED EMBODIMENTS

Figure 4:
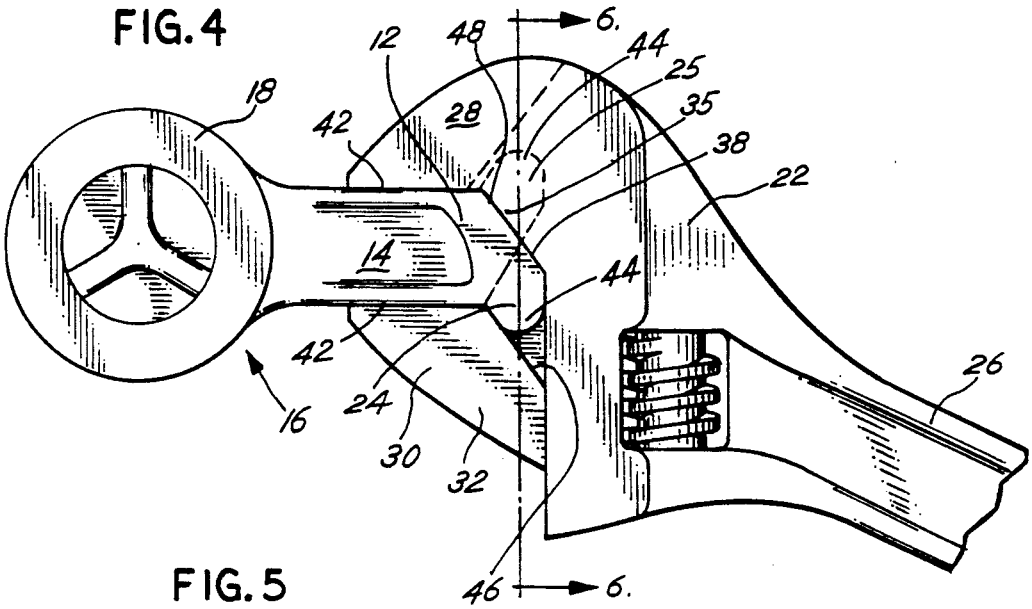
FIG. 4 is a top view of the ratchet wrench head shown in connected disposition with the expandable jaw wrench handle, and further showing (in dotted lines) one of the connector ears disposed within the internal gripping mechanism of the expandable jaw wrench.
Figure 5:
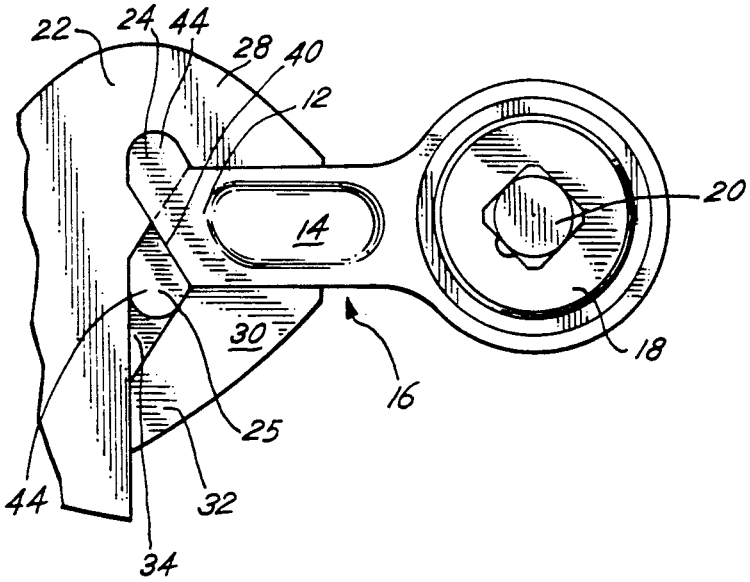
FIG. 5 is a view from below the ratchet wrench head and connected expandable jaw wrench, as shown in FIG. 4.
Figure 6:
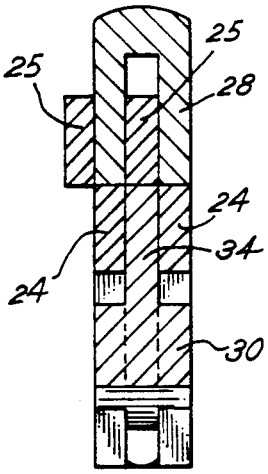
FIG. 6 is an enlarged cross-sectional view taken along lines 6—6 of FIG. 4, and showing the connection and impingement surfaces of the ratchet wrench head connector ears with the related elements of the expanded jaw wrench.

The present invention is directed to improvements in the tool arts, and in further particulars to a connector means which is disposed distally on the unitary handle of the ratchet wrench head, such relatively short unitary handle for turning the ratchet mechanism. Such connector means is disposed distally on such unitary handle for firmly connecting to and within the jaws of an expandable jaw wrench.

In preferred embodiments, such ratchet wrench head improvement comprising such connector means is directed yet more particularly to connector ear means. Such ear means are preferably disposed at the terminal portion of the unitary handle of the ratchet wrench head.

Such connector means mechanism of the present invention are disposed on the unitary handle for the ratchet wrench head, also to correspondingly dispose the handle of the expandable wrench within a substantially straight line which is substantially normal to the axis of rotation of the ratchet.

The adjustable or expandable jaw wrench for use in connection with the connector means improvement hereof includes in preferred embodiments a fixed jaw and a laterally adjustable jaw. The laterally adjustable jaw further includes a jaw body, a jaw root, and a worm gear mechanism for opening and closing such jaws, such as by providing relative movement of the laterally adjustable jaw relative to the fixed jaw.

The ear means of the improved connector mechanism hereof comprises in preferred embodiments a first pair of ears which are disposed respectively on respective sides of the jaw root of the laterally adjustable jaw wrench.

In preferred embodiments, such jaw root of the laterally adjustable jaw further comprises jaw root articulation means preferably in the form of a surface for contact with a work piece to be gripped. These jaw root articulation means slope in such embodiments downwardly and inwardly from the adjustable jaw body. In such preferred embodiments, the ear means further may preferably comprise a matching articulation surface for matching articulation during use with the jaw root articulation means and surface.

Such connector ear means hereof may preferably further comprise a second pair of interlockingly disposed ears disposed to face in an opposite radial direction from the first pair of ears. The result of such mutually oppositely facing interlockingly disposed ears is that the laterally adjustable jaw of the adjustable jaw wrench may be selectively disposed radially in front or radially behind the direction of rotation of the ratchet, as the user may select.

As shown more particularly hereinbelow, the unitary handle of the ratchet wrench head hereof further preferably comprises laterally disposed jaw articulation means for articulation with the jaw of the adjustable jaw wrench.

In such preferred embodiments, the first pair of ears of such connector means of the present invention comprises tab portions for griping between the undersurface of the jaw body of the laterally adjustable jaw and the top surface of the fixed jaw of the adjustable jaw wrench.

Yet further in preferred embodiments of the improved connector mechanism hereof, the fixed jaw of the adjustable jaw wrench further includes a matching indentation therein for containing the jaw root articulation means when the wrench is disposed in the closed position. Also, in such preferred embodiments, the second pair of interlockingly disposed ears is disposed within the matching indentation of the fixed jaw when in use. Referring name to the drawing, wherein common reference numerals are utilized for common elements, the present invention is directed to a connector means generally 10 which is disposed at a distal portion 12 on the unitary handle 14 of ratchet wrench generally 16. Unitary handle 14 of shown ratchet wrench heat attached to 18 is utilized for turning the ratchet mechanism 20 of ratchet wrench 16. As shown, such connector means 10 is disposed distally on unitary handle 14 for firmly connecting to and within the jaws of an expandable jaw wrench 22. As shown most particularly in FIGS. 2 and 3, such ratchet wrench head 18 has improvement connector means 10 which a first pair of connector ears 24, 24 and a second pair of connector ears 25, 25.

Figure 7:
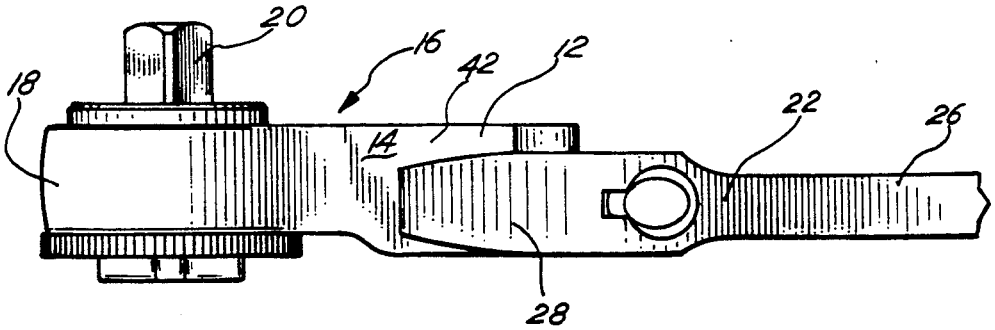
FIG. 7 is a partially fragmented side view of the ratchet wrench head and expandable jaw wrench, shown in connected and operable disposition, as shown in FIGS. 4 and 5, supra.

Such connector ears 24, 24 and 25, 25 are further disposed on unitary handle 14 of ratchet wrench head 18, also to correspondingly dispose expandable wrench handle 26 within a substantially straight line which is substantially normal to the axis of rotation of the ratchet 20, as shown in FIG. 7.

Adjustable jaw wrench, 22 for use in connection with connector means 10 hereof includes a fixed jaw 28 and a laterally adjustable jaw 30. As shown particularly in FIG. 2, laterally adjustable jaw 30 includes a jaw body 32 and a jaw root 34.

Connector means 10 of the improved connector mechanism hereof comprises a first pair of ears 24, 24 which are disposed respectively above and below jaw root 34 of such laterally adjustable jaw wrench 22. As shown in FIG. 2 in preferred embodiments, such jaw root 34 of laterally adjustable jaw 30 further comprises a jaw root articulation surface 36 for disposition near or contact with a work piece to be gripped. Such jaw root articulation surface 36 is sloped downwardly and inwardly from adjustable jaw body 32, as shown in FIG. 2. In such preferred embodiments, such connector ears respectively 24, 24 and 25, 25 further comprise a matching articulation surface respectively 38, 38 and 40, 40 for matching the articulating during use with fixed jaw articulation surface 35 and with jaw root articulation surface 36 respectively.

Such connector 24, 24 and 25, 25 are interlockingly disposed to face in an opposite radial directions, as shown in FIGS. 2, 3, 4 and 5. The result of such oppositely facing connector ears 24, 24 and 25, 25 is that the laterally adjustable jaw 30 of adjustable jaw wrench 22 may be selectively disposed radially in front or radially behind the direction of rotation of the ratchet 20, as the user may select.

Unitary handle 14 of ratchet wrench head 18 hereof further includes disposed jaw articulation means 42 for articulation with the jaws 28, 30 of adjustable jaw wrench 22.

In such preferred embodiments, the first pair of connector ears 24, 24 of such connector means 10 of the present invention comprises tab portions 44 for gripping between the undersurface 46 of jaw body 32 of laterally adjustable jaw 30 and the top surface 48 of fixed jaw 28 of adjustable jaw wrench 22.

As shown particularly 22 FIG. 2, improved connector means 10 hereof fixed jaw 28 of adjustable jaw wrench 22 further includes a matching indentation 50 therein for containing the jaw root 34 when adjustable wrench 22 is disposed in the closed position.

The basic and novel characteristics of the improved ratchet wrench head connector for use in combination with expandable jaw wrench will be readily understood from the foregoing disclosure by those skilled in the art. It will become readily apparent that various changes and modifications may be made in such methods of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. In combination, a ratchet wrench head and an expandable jaw wrench, wherein:

said expandable jaw wrench having distally disposed relatively movable jaws for gripping and a proximally disposed wrench handle, said expandable jaw wrench including a fixed jaw and a laterally adjustable jaw, said laterally adjustable jaw including a jaw body and a jaw root;

said ratchet wrench head having a rotatable ratchet mechanism, said rotatable ratchet mechanism having an axis of rotation, and further having a ratchet wrench unitary handle connected to said ratchet wrench head for turning the ratchet mechanism thereof, said unitary ratchet wrench handle disposed substantially normal to the axis of turning of said ratchet mechanism;

said ratchet wrench head further including ear connector means disposed at the terminal portion of said unitary handle thereof for firmly connecting to and being gripped within the jaws of said expandable jaw wrench, said ear connector means comprising a first pair of connector ears to be disposed on opposite respective sides of said jaw root; said ear connector means comprising means for disposing the unitary handle for the ratchet wrench head and the expandable wrench handle within a substantially straight line which is substantially normal to the axis of rotation of the ratchet mechanism.

2. The ratchet wrench head improvement of claim 1 wherein said jaw root of said laterally adjustable jaw further comprises jaw root articulation means for disposition near a portion of a work-piece to be gripped, said jaw root articulation means sloping downwardly and inwardly from the adjustable jaw body;

said ear connector means futher comprising a matching articulation surface for matchingly articulating with said jaw root articulation means.

3. The ratchet wrench head improvement of claim 2 wherein said ear connector means further comprises a second pair of ears disposed to face in an opposite radial direction from said first pair of ears.

4. The ratchet wrench had improvement of claim 1 wherein said unitary handle of the ratchet wrench head further comprises jaw articulation means disposed on lateral sides of said unitary handle for articulation with the jaws of the expandable jaw wrench.

5. The ratchet wrench head improvement of claim 1 wherein said first pair of connector ears comprise tab portion means for gripping between an exterior articulating surface of the jaw body of the laterally adjustable jaw and an opposing exterior articulating surface of the fixed jaw of said adjustable jaw wrench.

* * * * *